US009159270B2

(12) United States Patent
Ninan et al.

(10) Patent No.: US 9,159,270 B2
(45) Date of Patent: Oct. 13, 2015

(54) AMBIENT BLACK LEVEL

(75) Inventors: Ajit Ninan, San Jose, CA (US); Wenhui Jia, Dublin, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 126 days.

(21) Appl. No.: 13/817,244

(22) PCT Filed: Aug. 25, 2011

(86) PCT No.: PCT/US2011/049144

§ 371 (c)(1), (2), (4) Date: Feb. 15, 2013

(87) PCT Pub. No.: WO2012/030622

PCT Pub. Date: Mar. 8, 2012

(65) Prior Publication Data

US 2013/0147778 A1 Jun. 13, 2013

Related U.S. Application Data

(60) Provisional application No. 61/378,389, filed on Aug. 31, 2010.

(51) Int. Cl.
*G09G 5/00* (2006.01)
*G09G 3/34* (2006.01)

(52) U.S. Cl.
CPC ..... *G09G 3/3406* (2013.01); *G09G 3/3426* (2013.01); *G09G 2320/0238* (2013.01); *G09G 2320/066* (2013.01); *G09G 2320/0626* (2013.01); *G09G 2320/0646* (2013.01); *G09G 2360/144* (2013.01)

(58) Field of Classification Search
CPC ..... G09G 2320/06; G09G 2320/0626; G09G 2360/14; G09G 2360/141; G09G 2360/142; G09G 2360/144
USPC ..... 345/102, 207
See application file for complete search history.

(56) References Cited

U.S. PATENT DOCUMENTS

| | | | |
|---|---|---|---|
| 6,634,757 | B2 | 10/2003 | Asakawa |
| 6,952,195 | B2 | 10/2005 | Arakawa |
| 7,259,769 | B2 | 8/2007 | Diefenbaugh |
| 7,468,722 | B2 | 12/2008 | Ferguson |

(Continued)

FOREIGN PATENT DOCUMENTS

| | | |
|---|---|---|
| JP | 2001-051652 | 2/2001 |
| JP | 2010-066715 | 3/2010 |

(Continued)

*Primary Examiner* — Gene W Lee

(57) ABSTRACT

Techniques for operating a display system in a wide range of ambient light conditions are provided. An intensity of ambient light on a display panel may be detected. The display panel may be illuminated by light sources in addition to the ambient light. An individual light source may be individually settable to an individual light output level. If it is determined that the luminance level of the ambient light is above a minimum ambient luminance threshold, an ambient black level may be calculated using the intensity of ambient light. Light output levels of one or more of the light sources may be elevated to first light output levels. Here, the one or more light sources may be designated to illuminate one or more dark portions of an image. The first light output levels may create a new black level equaling the determined ambient black level.

21 Claims, 12 Drawing Sheets

(56) References Cited

U.S. PATENT DOCUMENTS

| | | | | |
|---|---|---|---|---|
| 7,518,320 | B2 | 4/2009 | Chen | |
| 2003/0169226 | A1 | 9/2003 | Yamada | |
| 2006/0007107 | A1* | 1/2006 | Ferguson | 345/102 |
| 2008/0068305 | A1* | 3/2008 | Tada | 345/77 |
| 2008/0106512 | A1 | 5/2008 | Schwab | |
| 2008/0208551 | A1 | 8/2008 | Kerofsky | |
| 2008/0290803 | A1 | 11/2008 | Santo | |
| 2008/0303806 | A1* | 12/2008 | Perrin | 345/207 |
| 2009/0152445 | A1 | 6/2009 | Gardner | |
| 2009/0184904 | A1 | 7/2009 | Saratoga | |
| 2009/0267876 | A1 | 10/2009 | Kerofsky | |
| 2010/0007599 | A1 | 1/2010 | Kerofsky | |
| 2010/0013866 | A1 | 1/2010 | Okabe | |
| 2010/0053222 | A1* | 3/2010 | Kerofsky | 345/690 |
| 2010/0073276 | A1 | 3/2010 | Koike | |
| 2010/0309107 | A1* | 12/2010 | Muroi et al. | 345/88 |
| 2011/0001737 | A1* | 1/2011 | Kerofsky et al. | 345/207 |
| 2011/0025728 | A1 | 2/2011 | Baba | |
| 2011/0032227 | A1* | 2/2011 | Miyaguchi | 345/207 |
| 2011/0074803 | A1* | 3/2011 | Kerofsky | 345/589 |

FOREIGN PATENT DOCUMENTS

| | | | |
|---|---|---|---|
| WO | WO 2009101727 | A1 * | 8/2009 |
| WO | 2010/073909 | | 7/2010 |

* cited by examiner

AMBIENT BLACK LEVEL

CROSS-REFERENCE TO RELATED APPLICATIONS

This application claims priority to U.S. Provisional Patent Application No. 61/378,389 filed 31 Aug. 2010, hereby incorporated by reference in its entirety.

TECHNOLOGY

The present invention relates generally to display systems, and in particular, to operating display systems across a wide range of ambient light conditions.

BACKGROUND

A high dynamic range (HDR) display system may support displaying images that vary greatly in luminance levels from the palest areas to the darkest areas in the images. Under existing techniques, a luminance level of the darkest areas in an image may be reduced to a very dark level lower than an ordinary display panel may otherwise support, while a luminance level of the palest areas in the image may be set to a relatively high luminance. Accordingly, in a dark viewing environment with little ambient light, a viewer may be able to see images rendered with a large amount of details in various luminance levels and tonality.

Some display systems may also employ tone-mapping techniques to create a perception of, or to simulate, a high dynamic range by mapping tonality settings of an image and by enhancing local contrast values in adjacent portions of the image. For example, various portions in an original image may be made further darker or paler based on a complex tone-mapping algorithm to create an altered image, which is then rendered on a display panel.

Many existing techniques depend on a dark environment to exploit their HDR ability. However, in a wide range of ambient light conditions, many details, even if rendered by an existing HDR system, of an image may be imperceptible to a viewer who happens to be exposed to only moderate or high ambient light. For example, image details such as those with very low luminance levels cannot be properly perceived by the viewer. Particularly, portions that are of a luminance level of 0.5 nit or below may be masked by and become indistinct under the ambient light. Consequently, a display system that implements a high dynamic range and/or tone mapping, at a great cost to a consumer/viewer, may in the end be limited to viewing environments only with little ambient light. Indeed, the HDR system may look even worse than a regular display system in many ambient light conditions, because of the former's susceptibility of losing details in such conditions.

Many existing techniques such as tone-mapping require complicated processing of large volumes of image data. Thus, such techniques have a tendency to be quite expensive to implement, but at the same time are limited to relatively ideal viewing environments.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE POSSIBLE EMBODIMENTS

Figure 1A:
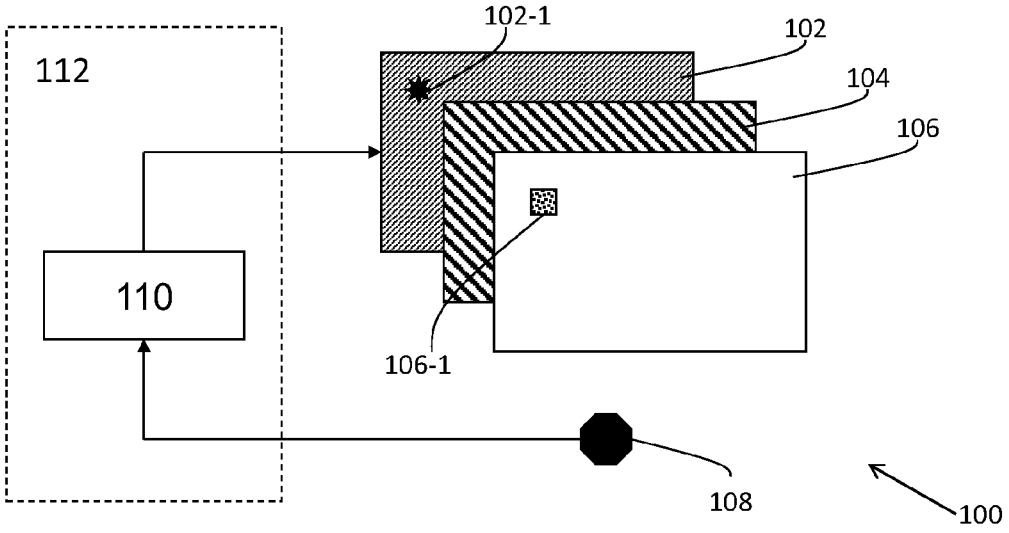
FIG. 1A and FIG. 1B illustrate example light sources in display systems, according to possible embodiments of the present invention.

Example possible embodiments, which relate to controlling light sources in display systems in a wide range of ambient light conditions, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily including, obscuring, or obfuscating the present invention.

Example embodiments are described herein according to the following outline:

1. GENERAL OVERVIEW
2. DISPLAY SYSTEMS
3. LIGHT SOURCE CONTROLLER AND AMBIENT BLACK LEVEL UNIT
4. LOCAL AND GLOBAL BLACK LEVELS
5. INTRINSIC BLACK LEVELS AND AMBIENT BLACK LEVELS
6. EXAMPLE LIGHT SOURCE CONFIGURATIONS
7. POINT SPREAD FUNCTIONS AND LUMINOSITY PROFILES
8. DYNAMIC RANGES IN VIEWING ENVIRONMENTS
9. EXAMPLE PROCESS FLOW
10. IMPLEMENTATION MECHANISMS—HARDWARE OVERVIEW
11. EQUIVALENTS, EXTENSIONS, ALTERNATIVES AND MISCELLANEOUS

1. GENERAL OVERVIEW

This overview presents a basic description of some aspects of a possible embodiment of the present invention. It should be noted that this overview is not an extensive or exhaustive summary of aspects of the possible embodiment. Moreover, it should be noted that this overview is not intended to be understood as identifying any particularly significant aspects or elements of the possible embodiment, nor as delineating any scope of the possible embodiment in particular, nor the invention in general. This overview merely presents some concepts that relate to the example possible embodiment in a condensed and simplified format, and should be understood as merely a conceptual prelude to a more detailed description of example possible embodiments that follows below.

Techniques for automatically controlling ambient black levels in a variety of viewing environments are described. In some possible embodiments, a display system may comprise a display panel. Ambient light conditions under which the display system renders images may vary from a very dark environment (e.g., an ambient luminance level of 0.01 nit) to a very bright environment (e.g., an ambient luminance level of >1 nit).

In some possible embodiments, a display panel as described herein may also be illuminated by a plurality of light sources. The light sources may be back light units (BLUs), for example, an LED array, in a LCD display system. A display system as described herein may control the luminance level of each composite color in a pixel based on image data of images in order to render these images on the display panel. In some possible embodiments, the display panel may comprise a plurality of light valves, for example, a two-dimensional array of LCD unit structures. The transmittance (e.g., ability to transmit light) of a light valve may be set based on a corresponding pixel value in the image data. The setting of transmittance may be used to regulate the amount of light passing through each pixel or colored sub-pixels therein towards a viewer.

In some possible embodiments, the display system may be configured to determine an intensity of ambient light based on measurements of ambient light on the display panel, to determine an ambient black level based on the intensity of ambient light, and to control the light output levels of the plurality of light sources to realize the ambient black level in the display panel. The measurements of ambient light may be made with one or more ambient light sensors, which may be disposed on, or located near, an image displaying area of the display panel.

A display system as described herein may be configured with ambient luminance thresholds separating a wide range of ambient light conditions into two or more operating ranges and an ambient black level controller for automatically and gracefully transitioning among, and operating in, these different operating ranges of ambient light conditions. The ambient black level controller may be configured to achieve the best possible dynamic range and viewable image details of rendered images on the display panel under the prevailing ambient light condition as continuously monitored by light sensors disposed on the display panel. An ambient black level as described herein is a global black level for the display panel under a range of ambient light conditions and may be efficiently set by regulating the light output levels of the plurality of light sources. Thus, under ambient black level techniques as described herein, the global black level of the display panel may be controlled on the basis of individual light sources, rather than on the basis of individual pixels or light valves. Since a light source may be used to illuminate a great many pixels or light valves, the ambient black level techniques may be implemented with a higher performance and a lower cost than other techniques that use tone-mapping or manual user adjustments/setting techniques. In some possible embodiments, the only input variable in an ambient black level function that determines an appropriate ambient black level in a specific viewing environment is the intensity of ambient light in the viewing environment; the ambient black level thus determined may be accomplished by simply adjusting the light output levels of the plurality of light sources, without requiring controlling individual light valves or pixels. In some other possible embodiments, the intensity of ambient light may be one of two or more input variables in determining the ambient black level; the two or more input variable includes at least one of a point spread function of a light source and a distance between two light sources; the point spread function and the distance may be preconfigured in the display system.

It should be noted that while the techniques as described herein do not require incorporating tone-mapping that manipulates pixels in an original image and converts the original image to a new image that is relatively suitable for rendering, a display system as described herein may optionally and/or additionally be used with tone-mapping or other alternative methods such as manual user adjustments/settings, if so desired.

In some possible embodiments, when an intensity of ambient light is at or below a minimum ambient luminance threshold, a display system may operate with an intrinsic black level of the display system. This intrinsic black level may be a characteristic of the display system independent of a specific value of the intensity of ambient light so long as the luminance level is at or below the minimum ambient luminance threshold. In an example, this intrinsic black level in a portion of an image may be a minimal luminance, for example, 0.01 nit, as minimally produced by light leakage from neighboring light sources that illuminate other portions of the image. In some possible embodiments, this intrinsic black level may be produced by controlling the light valves, and/or by (locally) turning off or dimming one or more light sources that are assigned to illuminate dark portions of an image while (locally) turning on or brightening other light sources that are assigned to illuminate pale portions of the same image. In this viewing environment with minimal ambient light, the inherent range of tonality, contrast values, etc., of a display system such as a HDR display system may be fully realized and the images may be displayed most vividly with the greatest amount of perceptible details.

In some possible embodiments, when an intensity of ambient light is above a maximum ambient luminance threshold, the display system may operate with a second intrinsic black level higher than the previously described intrinsic black level. This higher intrinsic black level may also be a characteristic of the display system independent of the intensity of ambient light so long as the intensity of ambient light is above the maximum ambient luminance threshold. In some possible embodiments, this higher intrinsic black level may be a black level intrinsically related to the light valves in the display system. For example, this higher intrinsic black level may be associated with the fact that an LCD display panel intrinsically leaks light when (1) light valves are set to minimum transmittances and (2) the plurality of light sources operates at the maximum light output levels. In this bright environment, a display system such as HDR display system may no longer operate at its best high dynamic range of tonality and contrast values which would be realizable in a very dark environment. However, under the techniques as described herein, the display system may be gracefully adjusted to operate at the best possible dynamic range of tonality and contrast values as the intensity of ambient light varies.

In some possible embodiments, when the intensity of ambient light is above a minimum ambient luminance threshold but at or below a maximum ambient luminance threshold, the display system may operate with an ambient black level that is determined by the intensity of ambient light. The ambient black level may be a function of, and vary with, the intensity of ambient light. The ambient black level may be produced by elevating one or more light sources assigned to relatively dark portions of an image. In some possible embodiments, light output levels of other light sources assigned to illuminate other portions of the same image may be elevated to create a brighter maximum luminance level in the display panel, in order to offset the impact on the range of tonality and contrast values from the elevation of the black level in the display panel. Thus, in these embodiments, both the black level and the maximum luminance level (white level) are elevated in a correlated way. In this viewing environment with intermediate ambient light, a display system such as a HDR display system may or may not operate at its best high dynamic range of tonality and contrast values, but will be gracefully adjusted to operate at the best possible dynamic range of tonality and contrast values under a broad range of ambient light conditions.

In some possible embodiments, techniques as described herein may be used to prevent a display system from attempting to make the darker area darker when the intensity of ambient light would be higher than the dark portions of an image. Indeed, a further darkening of the global black level in the display panel would be counterproductive as any details below the intensity of ambient light may not be perceptible to a viewer in such a viewing environment. As noted, techniques as described herein may be implemented with high efficiency and with a very low cost. In some possible embodiments, neither a display model (e.g., for adjusting gamma values of individual pixels in an input image) nor complicated image processing is a precondition to implement the techniques as described herein. Rather, the adjustment of ambient black level can be easily accomplished by adjusting light output levels of light sources with simple offsets via a simple feedback system using one or more light sensors. As a result, the details in an image will be rendered above the intensity of ambient light, making the image relatively easy for a viewer to perceive. Techniques as described herein can be easily incorporated into high quality display systems, for example, HDR display systems with local dimming. Techniques as described herein also may take advantage of the long tails from a light source's point spread function (PSF) to raise the white level at the same time of raising the black level above the intensity of ambient light.

Thus, techniques as described herein may be implemented to support operating a display system at its best possible ranges of contrast levels across a wide spectrum of viewing environments.

In some possible embodiments, mechanisms as described herein form a part of a display system, including but not limited to a handheld device, game machine, television, laptop computer, netbook computer, cellular radiotelephone, electronic book reader, point of sale terminal, desktop computer, computer workstation, computer kiosk, and various other kinds of terminals and display units.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. DISPLAY SYSTEMS

FIG. 1A illustrates an example display system 100 in accordance with some possible embodiments of the present invention. In some possible embodiments, the display system 100 comprises a plurality of light sources 102, an optical stack 104 and a display panel 106.

In a possible embodiment, the display panel 106 may comprise a plurality of light valves. For example, the display panel 106 may be an LCD panel comprising a plurality of LCD pixels or sub-pixels as light valves. In some possible embodiments, a light valve as described herein may transmit light between a minimum transmittance and a maximum transmittance. For example, the minimum transmittance may be 0.1%, 0.4%, or a different percentile maybe smaller or larger than the foregoing values, of the amount of backlight illuminated on the light valve. The maximum transmittance may be 4%, 10%, 20%, 40%, or a different percentile smaller or larger than the foregoing values, of the amount of backlight illuminated on the light valve. As described herein, the transmittance of a light valve may be individually set based on image data of an image that is to be rendered on the display panel 106.

As described herein, an optical stack (e.g., 104) may comprise one or more of optical, or electro-optical components such as diffusers, polarization layers, light-focusing layers (e.g., made of one or more light-redirecting optical prisms), reflective layers, substrate layers, thin films, retardation films, rubbing surfaces, light crystal layers, color and/or colorless filters, color enhancers, etc. For example, the optical stack 104 may comprise a diffuser such that backlight from the plurality of light sources 102, even though it may have a portion of light directed off axis relative to a z-axis (which is, e.g., a direction towards a viewer of the display system), may be redirected and evenly distributed by the diffuser into outgoing light that is substantially in the direction of the z-axis.

In possible embodiments, some or all of the foregoing components in an optical stack may be disposed behind the plurality of light sources 102, between the plurality of light sources 102 and the display panel 106, in front of the display panel 106, or a combination thereof.

The plurality of light sources 102 may, but are not limited to, be the same type of light sources. Each individual light source in the plurality of light sources 102 may be assigned to illuminate a different individual display portion on the display panel 106. A display portion on a display panel 106 may, but is not limited to, be of a particular geometric shape and/or size, which may or may not be the same as another display portion on the same display panel 106. For example, the plurality of light sources 102 may comprise an array of light emitting diodes (LEDs); a light source may comprise one or more LEDs.

As illustrated in FIG. 1A, one or more light sources (e.g., 102-1) in the plurality of light sources 102 may be assigned to illuminate a display portion 106-1 on the display panel 106. Similarly, one or more different light sources (e.g., other than 102-1) in the plurality of light sources 102 may be assigned to illuminate a different display portion other than 106-1 on the display panel 106. As used herein, a display portion on the display panel 106 may comprise one or more pixels or light valves; such a display portion may, additionally and/or optionally, comprise one or more color filters that cover the pixels or light valves.

In some possible embodiments, the light output level of a light source as described herein may be controlled individually or together with light output levels for one or more other light sources in the plurality of light sources 102. For example, a light source (e.g., 102-1) may be set as in one of one or more "on" states (e.g., fully on, partially on at one of 2, 4, 8, 16, 32, 64, 128, 256 or more levels, etc.), while a different light source in the plurality of light sources 102 may be set in an "off" state, or a same or different "on" state.

In some possible embodiments, the display system 100 may comprise, or may be configured to receive data from, one or more light sensors 108. The light sensors 108 may be disposed on, or located near, the display panel 106 to measure intensities of ambient light at one or more locations on the display panel 106. For example, the light sensors 108 may be configured to take measurements of wavelengths and strengths of color components in ambient light.

3. LIGHT SOURCE CONTROLLER AND AMBIENT BLACK LEVEL UNIT

In some possible embodiments, the display system 100 may comprise a light source controller 112 to monitor and control the states of each light source in the plurality of light sources. In some possible embodiments, the light source controller 112 may comprise an ambient black level unit 110 that is configured to receive data from the light sensors 108. The ambient black level unit 110 may be configured to monitor and process the data from the light sensors 108 to determine the intensity of ambient light present on the display panel 106. The light source controller 112, or the ambient black level unit 110 therein, may determine an appropriate black level for the display panel 106 and may adjust the light output levels of one or more light sources in the plurality of light sources 102 to achieve the determined black level.

As used herein, the term "intensity" may refer to a photometric luminous intensity, a luminance level, a brightness level, a weighted sum of intensity values, a weighted sum of gamma-corrected values, a luma value, etc.

As used herein, the term "black level" refers to a dark black level that is the lowest luminance level to be rendered on the display panel from light as provided by the plurality of light sources 102; the black level of the display panel may be automatically adjusted based on ambient light conditions. Once the black level is set in the display system, the details of an image will have a luminance level above the black level, for example, as a ratio above the black level. At the same time, because of the nature of point spread functions associated with the light sources, the peak luminance (for example, the white level) will be raised by tails of neighboring light sources above what would have been without the ambient light techniques as described herein. Hence, while the black level is adjusted up or elevated as the ambient light becomes brighter, the white level of the display panel is adjusted up or elevated too. The luminance level of the white level may or may nor increase with the same ratio with which the luminance level of the black level increases.

4. LOCAL AND GLOBAL BLACK LEVELS

In some embodiments, a display system may optionally and/or additionally implement local dimming techniques, which allows individual settings of light sources illuminating different portions of the displayable area of a display panel in the system. As a result, each display portion may have a local black level. For reasons of brevity, a (local) black level that is local to a display portion is referred to herein as "local black level", while a (global) black level, as previously discussed, that is the lowest luminance level to be rendered on the entire display panel is referred to herein as simply "black level". Similarly, each display portion may have a local white level in a display system that implements local dimming techniques. For reasons of brevity, a (local) white level that is local to a display portion is referred to herein as "local white level", while a (global) white level that is the maximum luminance level to be rendered on the entire display panel is referred to herein as simply "white level". In some embodiments, the dynamic range of a display system may be measured by a ratio of its white level to its black level.

5. INTRINSIC BLACK LEVELS AND AMBIENT BLACK LEVELS

A display system (e.g., 100) may have an intrinsic black level, which, for example, may be a very dark level that is suitable in a dark environment. As used herein, the term "intrinsic" refers to a black level that does not vary as the intensity of ambient light varies. The intrinsic black level may be related to the fact that light valves of the display panel 106 may leak light. A light source may have a long tail that extends its illumination beyond its assigned display portion of the display panel 106. A light valve may allow a low transmission of illuminated backlight even when the light valve is set to the maximum opaqueness (or the lowest transmittance). The long tail of illumination into non-assigned portions, combined with a non-zero minimal transmittance of light valves, may produce a non-zero intrinsic black level. In an example embodiment, an intrinsic black level may be engineered to 0.01 nit or lower in a HDR display system, using the local dimming technology commercially available from Dolby Laboratories.

In some possible embodiments, a display system (e.g., 100) may have a second higher intrinsic black level. For example, the plurality of light sources 102 may be set to fully on states. Thus, a display portion of the display panel 106 may be illuminated by its assigned light sources as well as long-tail illuminations from other (e.g., neighboring) light sources. This additive illumination may produce a non-zero black level even when a light valve is set to the maximum opaqueness (or the lowest transmittance).

In some possible embodiments, in one or more ranges of ambient light conditions, a black level as described herein may be a function of an input variable that is the intensity of ambient light; such a black level may be referred to as "ambient black level." In some possible embodiments, the light source controller 112, or the ambient black level unit therein, may control the light output levels of one or more light sources in the plurality of light sources 102 to create the ambient black level on the display panel 106 as determined by the intensity of ambient light, when a light valve is set to the maximum opaqueness (or the lowest transmittance).

6. EXAMPLE LIGHT SOURCE CONFIGURATIONS

Figure 1B:
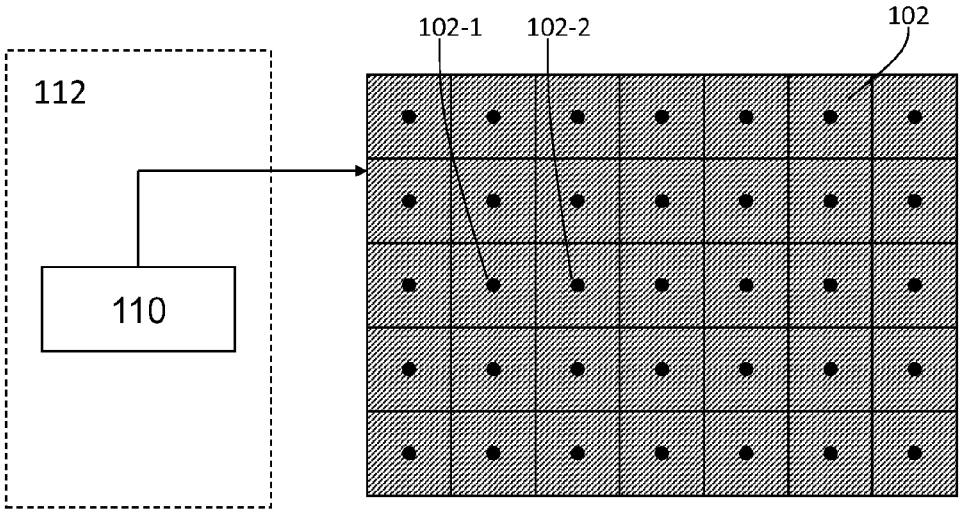

FIG. 1B illustrates an example configuration for a plurality of light sources (e.g., 102) in accordance with a possible embodiment of the present invention. The plurality of light sources 102 may be arranged in a grid pattern as illustrated. It should be noted that the grid pattern of FIG. 1B is used for illustration purposes only. In other possible embodiments, other grid patterns and/or other geometric patterns may be used to arrange a plurality of light sources (e.g., 102). In an example, a hexagonal grid pattern may be used to arrange the plurality of light sources 102. In another example, a diamond grid pattern may be used to arrange the plurality of light sources 102. In some possible embodiments, multiple grid patterns may be used at the same time. For example, a first subset of the plurality of light sources may be arranged in a first grid pattern, while a second subset of the plurality of light sources may be arranged in a second grid pattern. Additionally and/or optionally, the first subset of the plurality of light sources may be used as primary light sources, while the second subset of the plurality of light sources may be used as secondary light sources to be used when extra luminance is called for, in order to render a particular image or a group of images.

As discussed, a light source (e.g., 102-1) may be assigned to illuminate a display portion (e.g., 106-1) of the display panel 106, while a different light source (e.g., 102-2) may be assigned to illuminate a different portion (not shown) of the display panel 106. The states, including the light output levels, of the light sources (e.g., 102-1 and 102-2) may be individually or collectively controlled by the light source controller 112.

7. POINT SPREAD FUNCTIONS AND LUMINOSITY PROFILES

Figure 2A:
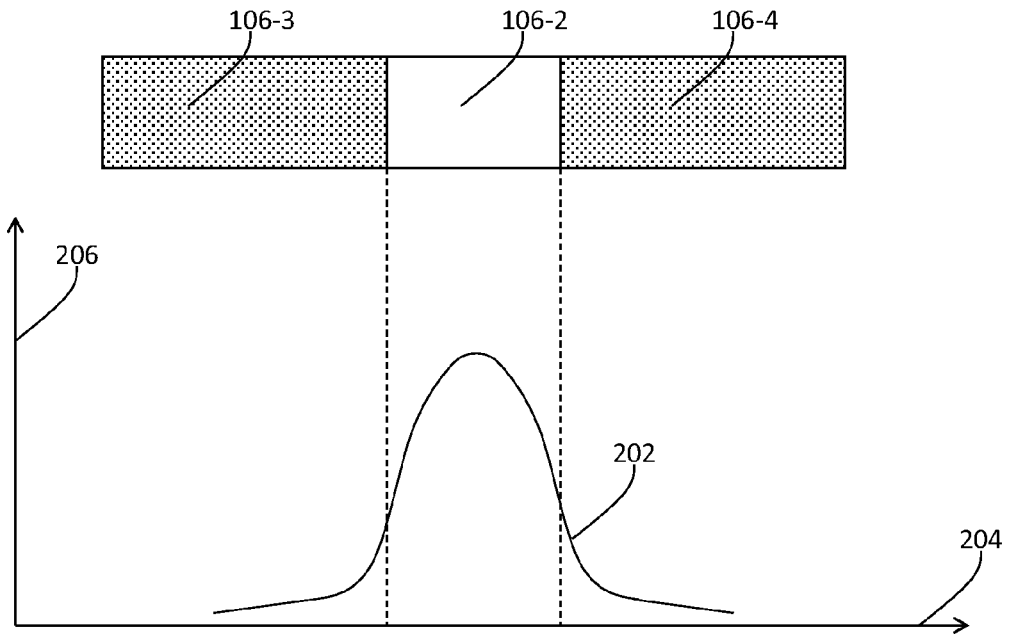
FIG. 2A through FIG. 2F illustrate example point spread functions and luminosity profiles, according to possible embodiments of the present invention.

FIG. 2A illustrates an example point spread function 202 of a light source (e.g., 102-1) in accordance with a possible embodiment of the present invention. In some possible embodiments, the point spread function 202 may represent the luminosity 206 of the light source 102-1 as a function of a spatial dimension 204 when the light source 102-1 is set to a particular light output level and when light valves of the display panel 106 are set according to pixel values in the image data. For example, the point spread function 202 may comprise a central portion of high illumination and two long-tail portions of low illumination. In some possible embodiments, the central portion of the point spread function 202 of the light source 102-1 may be assigned to illuminate a display portion 106-2 on the display panel 106, while the long-tail portions of the point spread function 202 may provide additional illumination in other display portions (e.g., 106-3 and 106-4) on the display panel 106.

Figure 2B:
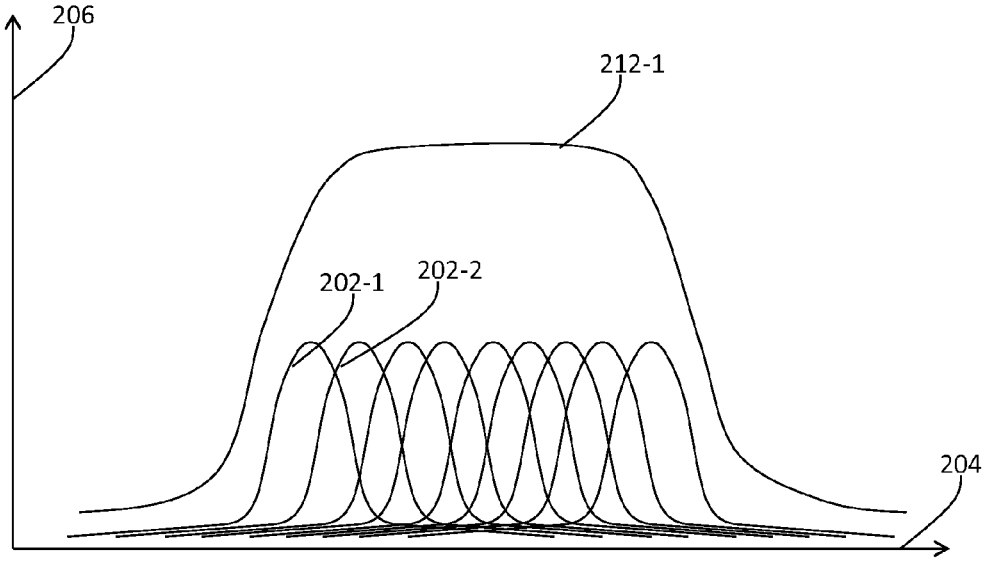

FIG. 2B illustrates an example luminosity profile 212-1 of luminosity in connection with two or more neighboring light sources in accordance with a possible embodiment of the present invention. The luminosity profile 212-1 represents the luminosity 206 provided by the light sources as a function of the spatial dimension 204 when the light sources are set to their respective light output levels. In some possible embodiments, the light sources are non-coherent and the luminosity profile may be formed by the additions of point spread functions (e.g., 202-1 and 202-2) of the light sources. The luminosity profile 212-1 may comprise one or more high illumination portions and two or more low illumination portions. In some embodiments where point spread functions have long tails, the luminosity in a low illumination portion of the luminosity profile 212-1 may be increased much more quickly than the luminosity in a high illumination portion of the luminosity profile 212-1.

Figure 2C:
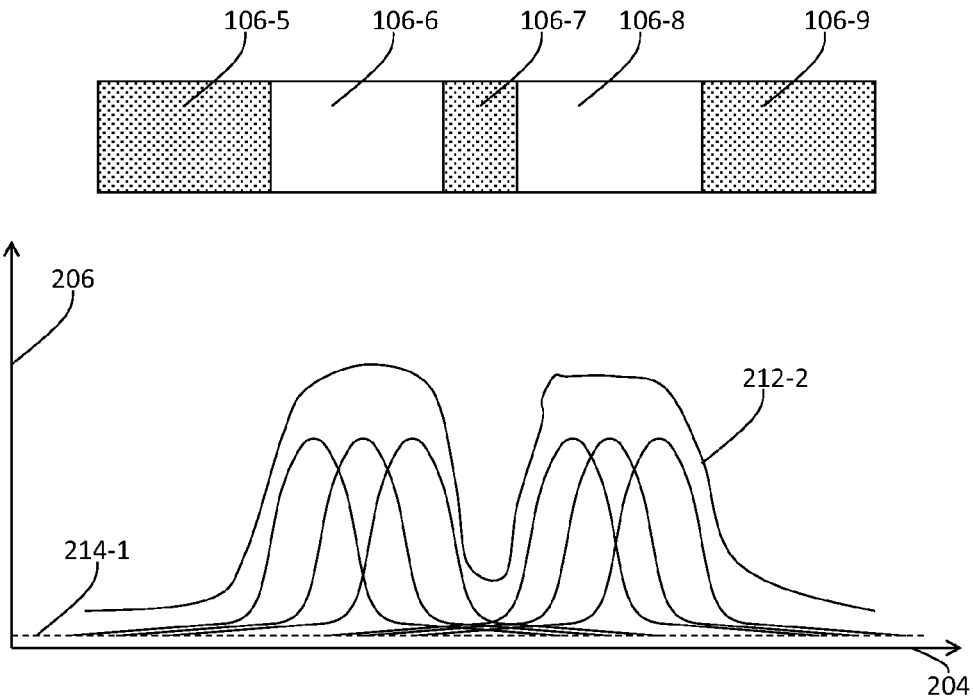

FIG. 2C illustrates an example luminosity profile 212-2 in connection with light sources that implement local dimming techniques in a dark viewing environment in accordance with possible embodiments of the present invention.

Based on image data of one or more images, the display panel 106, or its displayable area, may be partitioned into a number of display portions (e.g., 106-5 through 106-9). Various ways of partitioning into display portions based on image data may be used. In an example, the displayable area of the display panel 106 may be partitioned into equal-size blocks; these blocks may further form the display portions. In another example, the displayable area may be partitioned directly into variable-size display portions.

A display portion as described herein may comprise pixels or blocks of pixels whose luminance levels fall within a range of luminance levels that can be easily controlled by adjusting light output levels of light sources illuminating the display portion and by adjusting transmittances of light valves between the minimum transmittance and the maximum transmittance. The light valves may be configured to operate within this range from the minimum transmittance and the maximum transmittance. The transmittance of a light valve may be adjusted based on a pixel value that is to be loaded into a pixel.

Light output levels of light sources illuminating a display portion and the maximum transmittance of the light valves may be used to set a ceiling (or a local white level; local to the display portion) on the maximum luminance achievable on the display portion, while the same light output levels of the light sources illuminating the display portion and the minimum transmittance of the light valves may be used to set a floor (or a local black level; local to the display portion) on the minimum luminance.

As shown, two or more neighboring light sources in the plurality of light sources 102 may be assigned to illuminate the display portions 106-5 through 106-9. The light output levels of the light sources may be set differently. For example, one or more first light sources assigned to illuminate the display portion 106-6 may be set to a high light output level, while one or more second different light sources assigned to illuminate the display portion 106-7 may be set to a low output level, or the lowest (including possibly zero) level as illustrated in FIG. 2C by the absence of any point spread functions of any light sources corresponding to the display portion 106-7. As a result, the local black level and the local white level of the display portion 106-6 may be higher than the local black level and the local white level of the display portion 106-7, respectively.

In some possible embodiments, a display system as described herein may operate in an ambient light condition under which the intensity of ambient light is at a level indicated by 214-1 of FIG. 2C. In some possible embodiments, this intensity of ambient light 214-1 may be at or below a minimum ambient luminance threshold. This minimum ambient luminance threshold may be different in different types of display systems. For example, in an HDR display system, this minimum ambient luminance threshold may be 0.1, 0.01, or another value in the unit of nit. When the intensity of ambient light 214-1 is below this threshold, the display system may set the light output levels of light sources assigned to illuminate one or more dark portions of one or more images all the way to the lowest (including possibly zero) level. The black level under this type of ambient light conditions is intrinsic and depends on the minimum transmittance of light valves in the display panel 106 and the light leakage from long tails of light sources illuminating elsewhere in the display panel 106.

Figure 2D:
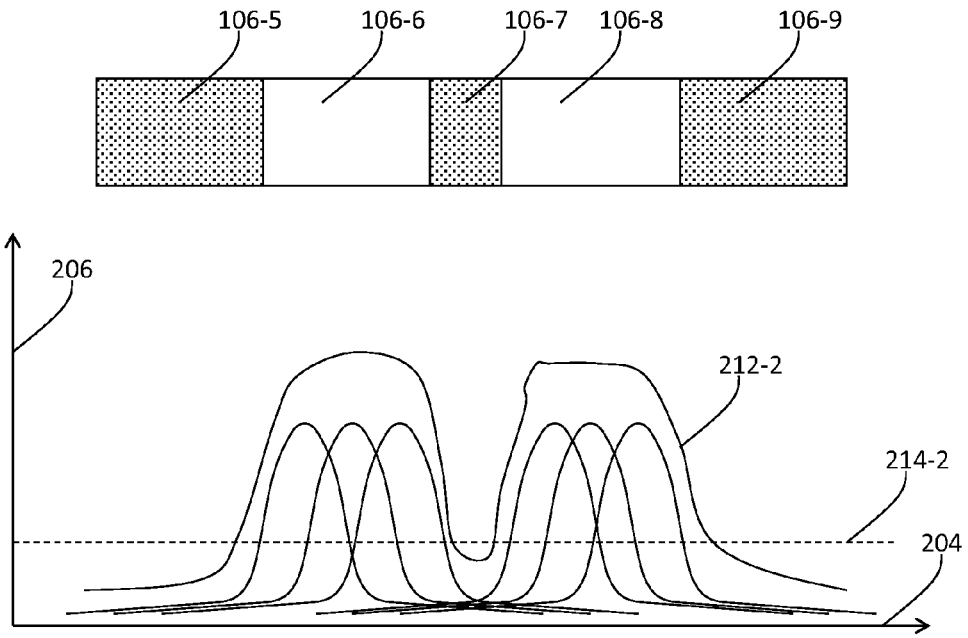

FIG. 2D illustrates an example luminosity profile 212-2 in connection with light sources that implement local dimming techniques in a moderate ambient light viewing environment in accordance with possible embodiments of the present invention.

In some possible embodiments, a display system may operate in an ambient light condition under which the intensity of ambient light is at a level indicated by 214-2 of FIG. 2D. In some possible embodiments, this intensity of ambient light 214-2 may be above the minimum ambient luminance threshold but at or below a maximum ambient luminance threshold. The maximum ambient luminance threshold may be different in different types of display systems, and may be 0.5, 1, 2, or another value in the unit of nit. When the intensity of ambient light 214-2 is between the minimum ambient luminance threshold and the maximum ambient luminance threshold, if the display system maintains the same light output levels of light sources assigned to illuminate the display portions

106-5 through 106-9, then the intensity of ambient light is above the black levels in these display portions. As a result, not only image details in the dark portions may not be perceptible to a viewer, but any pixels in the non-dark portions below the intensity of ambient light may also not be perceptible to the viewer.

Figure 2E:
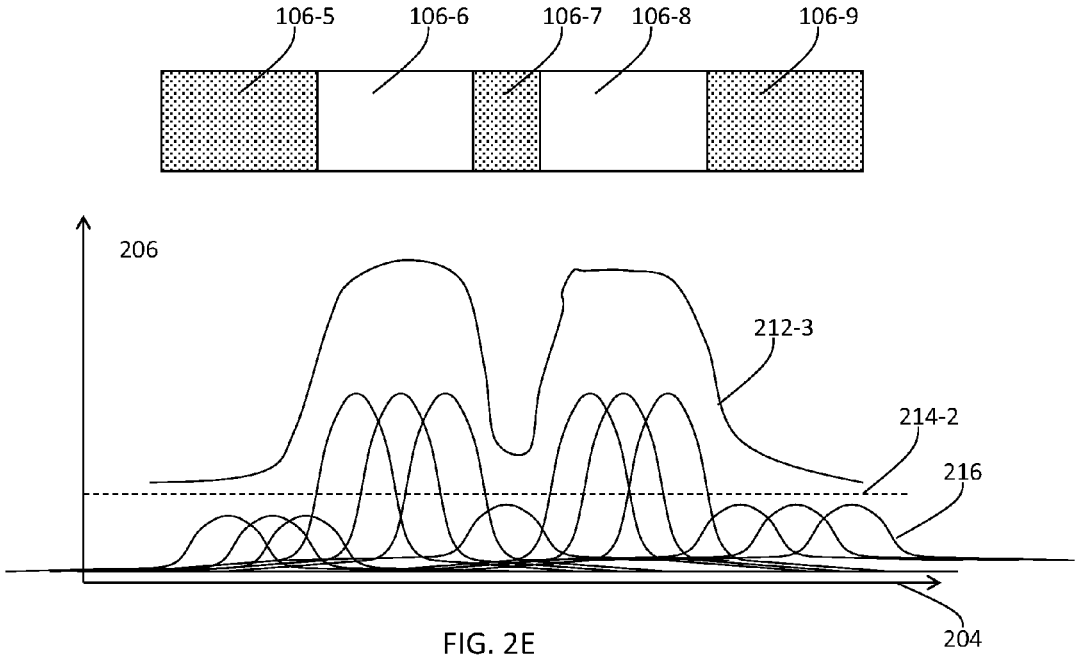

FIG. 2E illustrates an example luminosity profile 212-3 in connection with light sources that implement local dimming techniques in a moderate ambient light viewing environment in accordance with possible embodiments of the present invention.

As illustrated, the intensity of ambient light 214-2 may be above the minimum ambient luminance threshold but at or below a maximum ambient luminance threshold. In some possible embodiments, the minimum ambient luminance threshold and the maximum ambient luminance threshold may be configured differently in different types of display systems. In some possible embodiments, when the intensity of ambient light 214-2 is between the minimum ambient luminance threshold and the maximum ambient luminance threshold, an ambient black level may be determined based on the intensity of ambient light 214-2. In an example, the ambient black level may be set to the same as the intensity of ambient light 214-2. In another example, the ambient black level may be set to be proportional to the intensity of ambient light 214-2. In some possible embodiments, the ambient black level may be determined as a function of the intensity of ambient light 214-2. In a possible embodiment, the ambient black level may be determined as a function with the intensity of ambient light as the only input variable. In some other possible embodiments, the intensity of ambient light may be one of two or more input variables in determining the ambient black level; the two or more input variable includes at least one of a point spread function of a light source and a distance between two light sources; the point spread function and the distance may be preconfigured in the display system. Thus, a simple feedback loop may be implemented using the light sensors 108 disposed on the display panel 106.

In some embodiments, the display system may be configured to elevate light output levels of light sources in the plurality of light sources 102 to set the ambient black level as the global black level of the display panel 106. For example, under the ambient black level techniques as described herein, light output levels of light sources assigned to illuminate dark portions, such as the display portions 106-5, 106-7 and 106-9, of the image or images may be elevated by an offset to that shown in FIG. 2D. Thus, instead of being turned off to achieve a lower black level, these light sources in the dark portions of the image or images are turned on (which, for example, may be an intermediate "on" state). Thus, the point-spread functions (e.g., 216) of these light sources are now present.

In some possible embodiments, additionally and/or optionally, light output levels of all light sources in the plurality of light sources 102 may be elevated by an offset to a higher output level than that shown in FIG. 2D under the same ambient light condition. In some embodiments, if the offset would cause a light source to operate beyond its maximum luminosity, then the light source would default to the maximum luminosity.

As used herein, the term "offset" may refer to an addition term, a multiplicative factor, or a combination thereof; the offset may be used to add, to scale, or to otherwise elevate/adjust a light output level from an original value that would be suitable in a dark environment to a new value that will be suitable under the prevailing ambient light condition. In some possible embodiments, offset may be given by a variable function or a table whose values vary with intensities of ambient light. In some possible embodiments, various ways of elevating light output levels of one or more light sources in the plurality of light sources 102 may be used. For example, an offset to elevate the light output level of one light source may not be the same as another offset to elevate the light output level of another light source.

In some possible embodiments, a lookup table may be set up to select an offset for a light source. For example, the lookup table may be keyed by various values of the ambient black level. Thus, once the ambient black level is determined based on the intensity of ambient light, one or more offsets may be looked up or located in the lookup table using the ambient black level as the key. In some embodiments, the lookup table may have a composite key that includes the ambient black level as well as the area size of a display portion, neighboring portions' luminance level, etc. Thus, the lookup table may be used to locate an appropriate offset for one or more light sources in the plurality of light sources 102 under an ambient light condition.

Since the ambient black level is set at or alternatively near the intensity of ambient light, the image details remain perceptible to a viewer. In some possible embodiments, the dynamic range of contrast values of the display system may be the highest when the intensity of ambient light is at or below the minimum ambient luminance threshold, for example, in a dark viewing environment. In some possible embodiments, under the ambient black level techniques, the dynamic range of contrast values of the display system remains relatively high in a low ambient light condition; and the dynamic range is only gradually and gracefully reduced across a wide range of ambient light conditions, while at the same time maintaining the maximum image details and the maximum dynamic range attainable, relative to a present ambient light condition.

Figure 2F:
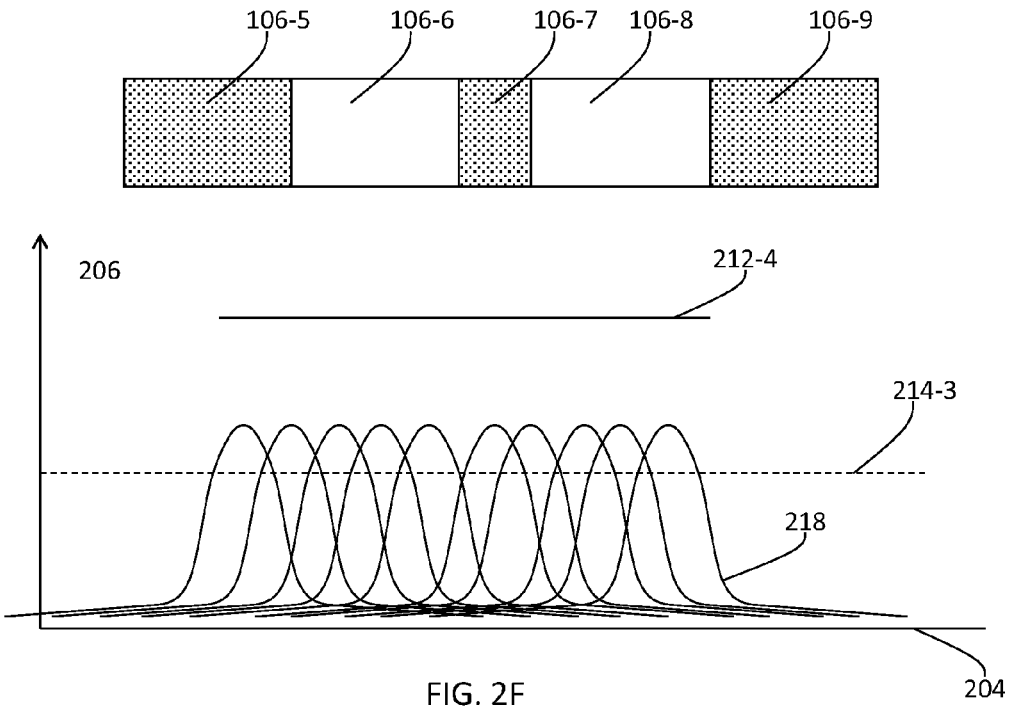

FIG. 2F illustrates an example luminosity profile 212-4 in connection with light sources that implement local dimming techniques in a bright environment in accordance with possible embodiments of the present invention.

As illustrated, the intensity of ambient light 214-3 may be above the maximum ambient luminance threshold. In some possible embodiments, when the intensity of ambient light 214-2 is above the maximum ambient luminance threshold, the display system may be configured to elevate light output levels of light sources in the plurality of light sources 102 to maximums corresponding to fully "on" states. For example, under the ambient black level techniques as described herein, light output levels of light sources assigned to illuminate dark portions, such as the display portions 106-5, 106-7 and 106-9, of the image or images may be set to maximums corresponding to fully "on" states. Thus, instead of being turned off to achieve a lower black level, these light sources in the dark portions of the image or images are turned on. Thus, the point-spread functions (e.g., 216) of these light sources are now present as modulated by light valves of the display panel 106.

Additionally and/or optionally, light output levels of all light sources in the plurality of light sources 102 may be elevated to maximum luminosities.

Since the intensity of ambient light is above the black level of the display panel 106, some image details of some types of images (e.g., containing relatively dark portions may be masked by the ambient light and become imperceptible to a viewer. In some possible embodiments, under the ambient black level techniques, the dynamic range of contrast values of the display system remains as high as best possible in the bright environment, while at the same time exposing as much image details as possible above the intensity of ambient light.

8. DYNAMIC RANGES IN VIEWING ENVIRONMENTS

Figure 3:
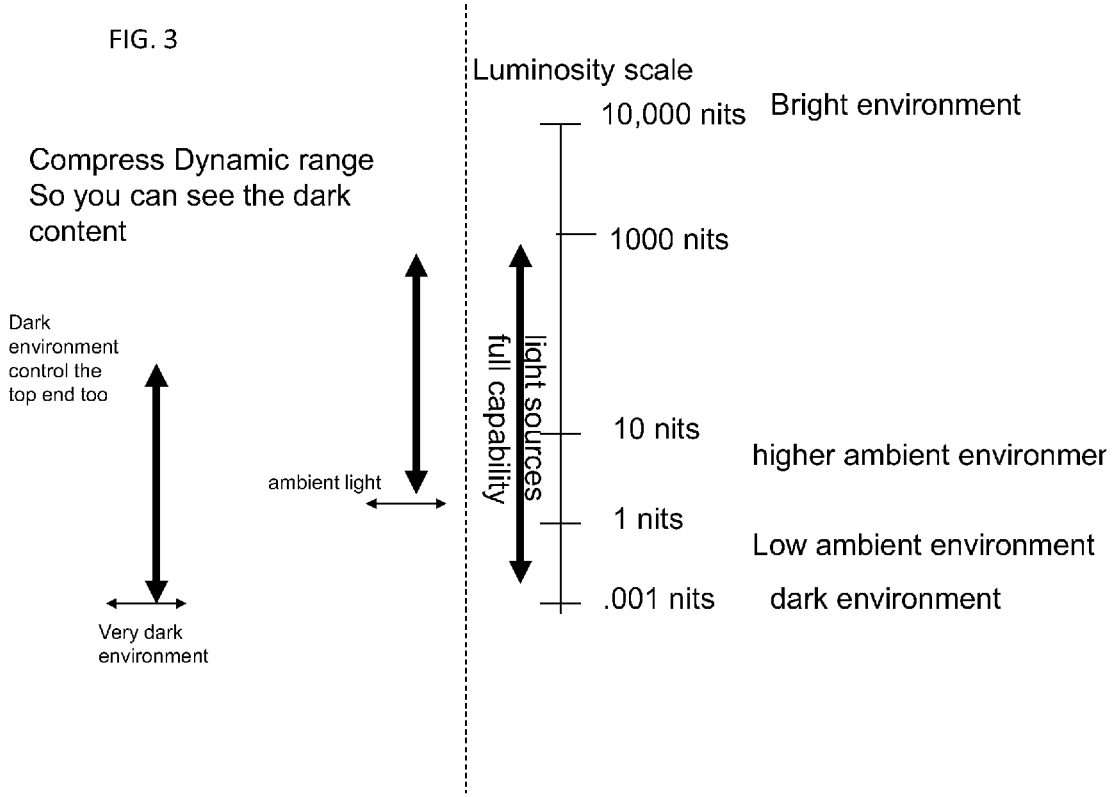
FIG. 3 illustrates example dynamic ranges in various viewing environments in accordance with possible embodiments of the present invention.

FIG. 3 illustrates example dynamic ranges in various viewing environments in accordance with possible embodiments of the present invention.

For example, in a very dark environment, a dynamic range of a display system as described herein may have a low black level, for example, near or at 0.01 nit. In some embodiments, even though the full capability of light sources may permit a very high luminosity, the top end of the dynamic range is still controlled/reduced for the purpose of providing a relatively pleasant viewing experience, as full luminosities from the light sources under the very dark environment may create a perception of too much brightness in certain display portions of an image at the top end of the dynamic range to prevent a viewer from seeing darker content.

In a wide range of low to high ambient light conditions, the dynamic range of the display system may vary from that close to the very dark environment to a high ambient light condition. This may be accomplished by adjusting the black level to the ambient black level as determined from a specific intensity of ambient light in the current ambient light condition and/or by controlling the top end of the luminosity.

As the ambient light continuously increases to result in a bright environment, the display system may set the light sources to full luminosities, at which point the display system may settle into an operational mode where image details at the lowest end of luminance are gradually lost.

It should be noted that a display system (e.g., 100) as described herein may use ambient black level techniques in place of, and/or in conjunction with, other image displaying techniques. For example, while the ambient black level techniques can be integrated into a display system, other techniques such as local dimming, tone-mapping, and display model-based image alteration may be used in conjunction with, or in complement to, the ambient black level techniques. For example, tone-mapping techniques may be used when the luminance level of the ambient light is above a maximum ambient luminance threshold. As used herein, tone mapping refers to techniques that convert an image as specified in the received image data into an alternative image by altering the tonality of pixels in the original image; the alternative image may improve perception of a viewer over the original image for the same visual context. In some embodiments, other techniques other than ambient black level techniques as described herein may, but are not required to, be used in a dark environment, in a wide range of ambient light conditions, or in a bright environment.

9. EXAMPLE PROCESS FLOW

Figure 4A:
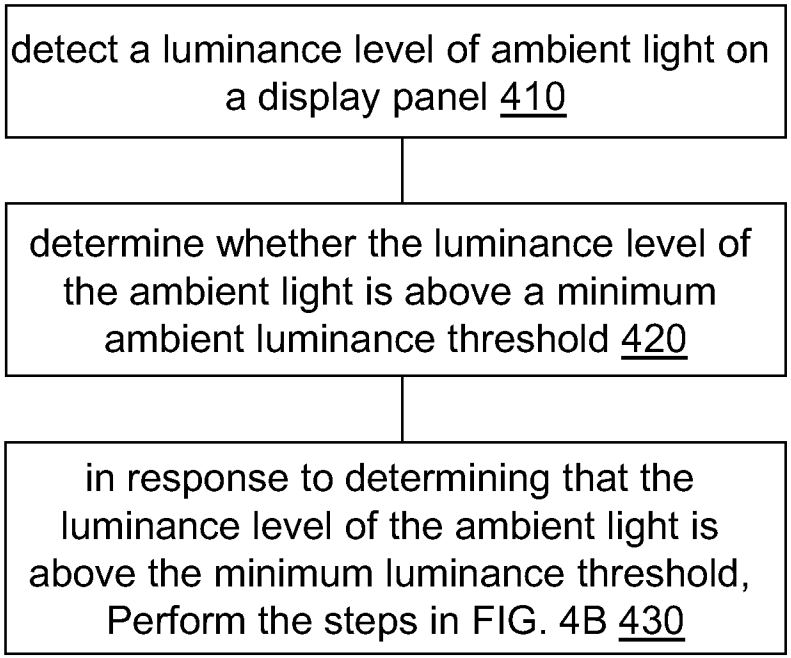
FIG. 4A and FIG. 4B illustrate example process flows, according to a possible embodiment of the present invention.
Figure 4B:
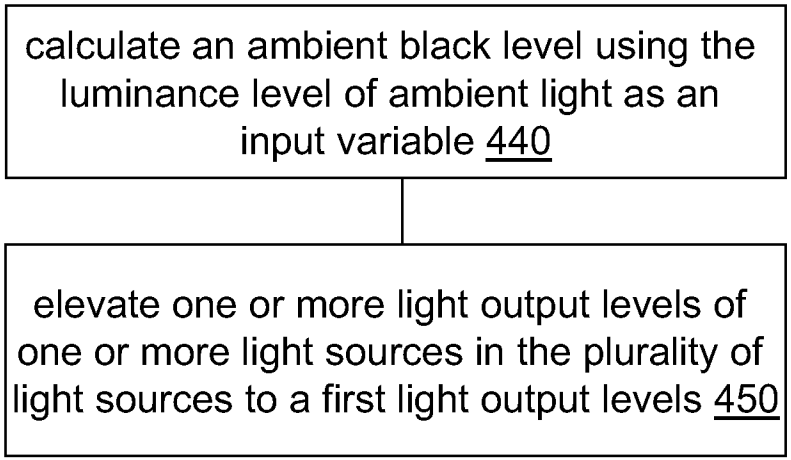

FIG. 4A and FIG. 4B illustrate example process flows according to a possible embodiment of the present invention. In some possible embodiments, one or more computing devices or components in a display system may perform this process flow.

In block 410 of FIG. 4A, a display system (e.g., 100) detects, for example, by one or more light sensors, an intensity of ambient light on a display panel (e.g., 106). To detect a luminous level of ambient light, the display system 100 may continuously monitor the luminance level of the ambient light using the one or more light sensors. The light sensors may be used to measure the intensity of ambient light at one of the front, the rear, one or more sides, or any combination thereof, of the display panel. In some possible embodiments, the display panel 106 may comprise a plurality of light valves that may be controlled based on image data of the image.

The display panel 106 may also be illuminated by a plurality of light sources (e.g., 102) other than the ambient light. Each individual light source in the plurality of light sources 102 may be individually settable to an individual light output level. In some possible embodiments, the plurality of light sources may be a plurality of backlights. In some possible embodiments, the plurality of light sources may be an array of LEDs.

In some possible embodiments, pixels of the display panel may comprise a plurality of display portions illuminated by the plurality of light sources. Each individual light source in the plurality of light sources may be assigned to illuminate a different individual display portion in the plurality of display portions.

In block 420 of FIG. 4A, the display system 100 determines whether the luminance level of the ambient light is above a minimum ambient luminance threshold. This determination may be performed, for example, by comparing a digital measurement value from the light sensors with a preconfigured value for the minimum ambient luminance threshold.

In block 430 of FIG. 4A, in response to determining that the luminance level of the ambient light is above the minimum luminance threshold, the display system 100 performs the steps in FIG. 4B.

In block 440 of FIG. 4B, the display system 100 calculates an ambient black level using the intensity of ambient light as an input variable. In some possible embodiments, the ambient black level may be determined by a function of the luminance level of the ambient light. An example of such a function may be a linear function, an analytic function, a discrete valued function, a table-driven function, a logic function, a combination of the foregoing, etc.

In block 450 of FIG. 4B, the display system 100 elevates one or more light output levels of one or more light sources in the plurality of light sources 102 to first light output levels. In some possible embodiments, to elevate the light output levels, drive currents to the light sources may be increased. The one or more light sources in the plurality of light sources 102 may be designated to illuminate one or more dark portions of an image. The first light output levels may create a new black level at the ambient black level in the display panel for the image. In some possible embodiments, a contrast ratio of the display panel may vary with the ambient black level. In some possible embodiments, the display system 100 may set at least one of the plurality of light sources to a light output level above a minimal light output level. The at least one of the plurality of light emitters may illuminate at least one of the plurality of display portions. The at least one of the plurality of display portions may comprise pixels that are specified by image data of the image to be illuminated below the luminance level of the ambient light.

In some possible embodiments, the display system 100 may determine whether the luminance level of the ambient light is above a maximum ambient luminance threshold.

In response to determining that the luminance level of the ambient light is above the maximum luminance threshold, the display system 100 may additionally and/or optionally perform tone-mapping techniques. For example, the display system 100 may analyze tonality information to portions of an image, map the image to a new image, and render the new image instead of the (original) image on the display panel 106.

In some possible embodiments, the tone-mapping techniques as described herein may also be performed in response to determining that the luminance level of the ambient light is above the minimum luminance threshold. Additionally and/or alternatively, the tone-mapping techniques as described herein may be performed in response to determining that the luminance level of the ambient light is not above the minimum luminance threshold.

In some possible embodiments, the intensity of ambient light is the only input variable in determining the ambient black level. In some other possible embodiments, the intensity of ambient light may be one of two or more input variables in determining the ambient black level; the two or more input variable includes at least one of a point spread function of a light source and a distance between two light sources; the point spread function and the distance may be preconfigured in the display system.

In some possible embodiments, in response to determining that the luminance level of the ambient light is not above the minimum luminance threshold, the display system 100 may performing setting the ambient black level to a preconfigured high dynamic range black level, so long as the intensity of ambient light is not above the minimum luminance threshold, and setting the one or more light output levels of the one or more light sources in the plurality of light sources to a lowest (including possibly zero) light output levels.

In some possible embodiments, the global black level of the display panel 106 may be a preconfigured high dynamic range black level when the luminance level of the ambient light is not above the minimum ambient luminance threshold; the global black level may be solely determined by the luminance level of the ambient light when the luminance level of the ambient light above the minimum ambient luminance threshold but not above the maximum ambient luminance threshold; and the global black level may be a preconfigured display panel black level when the luminance level of the ambient light is above the maximum ambient luminance threshold.

In some possible embodiments, the global black level may be the darkest (or lowest including possibly zero) when the luminance level of the ambient light is not above the minimum ambient luminance threshold; the global black level may be solely determined by the luminance level of the ambient light when the luminance level of the ambient light is above the minimum ambient luminance threshold but not above the maximum ambient luminance threshold; and the global black level may be set to the maximum ambient luminance threshold when the luminance level of the ambient light is above the maximum ambient luminance threshold.

10. IMPLEMENTATION MECHANISMS—HARDWARE OVERVIEW

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 5:
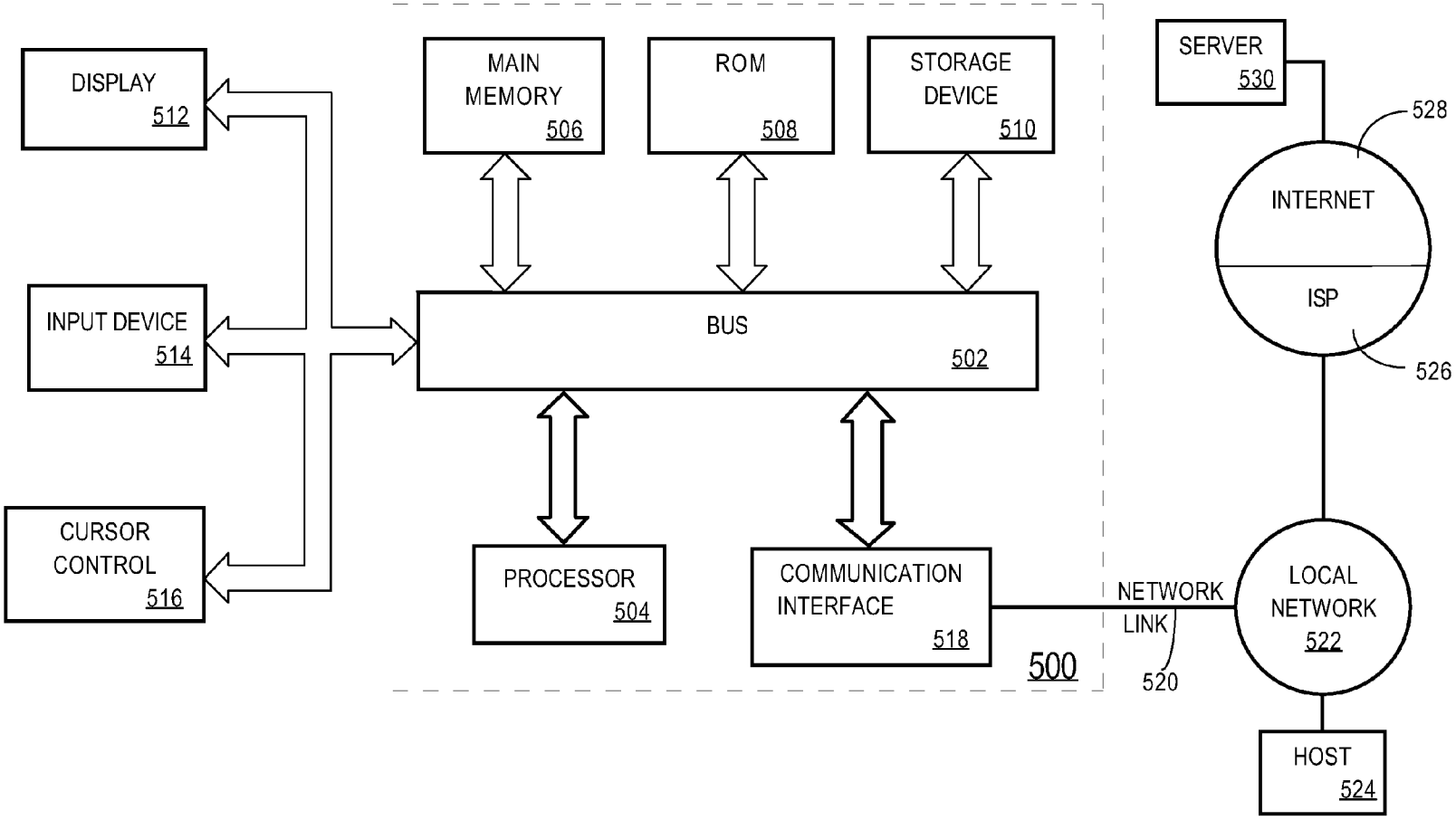
FIG. 5 illustrates an example hardware platform on which a computer or a computing device as described herein may be implemented, according a possible embodiment of the present invention.

For example, FIG. 5 is a block diagram that illustrates a computer system 500 upon which an embodiment of the invention may be implemented. Computer system 500 includes a bus 502 or other communication mechanism for communicating information, and a hardware processor 504 coupled with bus 502 for processing information. Hardware processor 504 may be, for example, a general purpose microprocessor.

Computer system 500 also includes a main memory 506, such as a random access memory (RAM) or other dynamic storage device, coupled to bus 502 for storing information and instructions to be executed by processor 504. Main memory 506 also may be used for storing temporary variables or other intermediate information during execution of instructions to be executed by processor 504. Such instructions, when stored in storage media accessible to processor 504, render computer system 500 into a special-purpose machine that is customized to perform the operations specified in the instructions.

Computer system 500 further includes a read only memory (ROM) 508 or other static storage device coupled to bus 502 for storing static information and instructions for processor 504. A storage device 510, such as a magnetic disk or optical disk, is provided and coupled to bus 502 for storing information and instructions.

Computer system 500 may be coupled via bus 502 to a display 512 for displaying information to a computer user. An input device 514, including alphanumeric and other keys, is coupled to bus 502 for communicating information and command selections to processor 504. Another type of user input device is cursor control 516, such as a mouse, a trackball, or cursor direction keys for communicating direction information and command selections to processor 504 and for controlling cursor movement on display 512. This input device typically has two degrees of freedom in two axes, a first axis (e.g., x) and a second axis (e.g., y), that allows the device to specify positions in a plane. Computer system 500 may be used to control the display system (e.g., 100 in FIG. 1). In some possible embodiments, display 512 is the same as display 100. In some other embodiments, display 512 may be a separate display to the display system 100.

Computer system 500 may implement the techniques described herein using customized hard-wired logic, one or more ASICs or FPGAs, firmware and/or program logic which in combination with the computer system causes or programs computer system 500 to be a special-purpose machine. According to one embodiment, the techniques herein are performed by computer system 500 in response to processor 504 executing one or more sequences of one or more instructions contained in main memory 506. Such instructions may be read into main memory 506 from another storage medium, such as storage device 510. Execution of the sequences of instructions contained in main memory 506 causes processor 504 to perform the process steps described herein. In alternative embodiments, hard-wired circuitry may be used in place of or in combination with software instructions.

The term "storage media" as used herein refers to any media that store data and/or instructions that cause a machine to operation in a specific fashion. Such storage media may comprise non-volatile media and/or volatile media. Non-volatile media includes, for example, optical or magnetic disks, such as storage device 510. Volatile media includes dynamic memory, such as main memory 506. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 502. Transmission media can also take the form of acoustic or light waves, such as those generated during radio-wave and infra-red data communications.

Various forms of media may be involved in carrying one or more sequences of one or more instructions to processor 504 for execution. For example, the instructions may initially be carried on a magnetic disk or solid state drive of a remote computer. The remote computer can load the instructions into its dynamic memory and send the instructions over a telephone line using a modem. A modem local to computer system 500 can receive the data on the telephone line and use an infra-red transmitter to convert the data to an infra-red signal. An infra-red detector can receive the data carried in the infra-red signal and appropriate circuitry can place the data on bus 502. Bus 502 carries the data to main memory 506, from which processor 504 retrieves and executes the instructions. The instructions received by main memory 506 may optionally be stored on storage device 510 either before or after execution by processor 504.

Computer system 500 also includes a communication interface 518 coupled to bus 502. Communication interface 518 provides a two-way data communication coupling to a network link 520 that is connected to a local network 522. For example, communication interface 518 may be an integrated services digital network (ISDN) card, cable modem, satellite modem, or a modem to provide a data communication connection to a corresponding type of telephone line. As another example, communication interface 518 may be a local area network (LAN) card to provide a data communication connection to a compatible LAN. Wireless links may also be implemented. In any such implementation, communication interface 518 sends and receives electrical, electromagnetic or optical signals that carry digital data streams representing various types of information.

Network link 520 typically provides data communication through one or more networks to other data devices. For example, network link 520 may provide a connection through local network 522 to a host computer 524 or to data equipment operated by an Internet Service Provider (ISP) 526. ISP 526 in turn provides data communication services through the world wide packet data communication network now commonly referred to as the "Internet" 528. Local network 522 and Internet 528 both use electrical, electromagnetic or optical signals that carry digital data streams. The signals through the various networks and the signals on network link 520 and through communication interface 518, which carry the digital data to and from computer system 500, are example forms of transmission media.

Computer system 500 can send messages and receive data, including program code, through the network(s), network link 520 and communication interface 518. In the Internet example, a server 530 might transmit a requested code for an application program through Internet 528, ISP 526, local network 522 and communication interface 518. The received code may be executed by processor 504 as it is received, and/or stored in storage device 510, or other non-volatile storage for later execution.

11. EQUIVALENTS, EXTENSIONS, ALTERNATIVES AND MISCELLANEOUS

In the foregoing specification, possible embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method, comprising:

detecting, on a display panel, a luminance level of ambient light, the display panel being illuminated by a plurality of light sources, and each individual light source in the plurality of light sources being individually settable to an individual light output level;

determining whether the luminance level of the ambient light is above a minimum ambient luminance threshold;

wherein if the luminance level of the ambient light is at or below the minimum ambient luminance threshold the display panel is to operate with an intrinsic black level;

wherein the intrinsic black level being determined at least in part on a minimal luminance in a portion of the display panel as produced by light leakage from neighboring light sources, in the plurality of light sources, that are illuminating other portions of the display panel; and in response to determining that the luminance level of the ambient light is above the minimum luminance threshold:

calculating an ambient black level using the luminance level of the ambient light as an input variable, wherein the ambient black level is at or near the luminance level of the ambient light; and elevating one or more light output levels of one or more light sources in the plurality of light sources to first light output levels, the one or more light sources in the plurality of light sources being designated to illuminate one or more dark portions of an image, and the first light output levels creating a new black level at the ambient black level in the display panel for the image.

2. The method of claim 1, comprising:

determining whether the luminance level of the ambient light is above a maximum ambient luminance threshold; and in response to determining that the luminance level of the ambient light is above the maximum luminance threshold:

analyzing tonality information to portions of an image;

mapping the image to a new image; and rendering the new image on the display panel.

3. The method of claim 1, comprising:

in response to determining that the luminance level of the ambient light is above the minimum luminance threshold, performing:

analyzing tonality information to portions of an image;

mapping the image to a new image; and rendering the new image on the display.

4. The method of claim 1, wherein the luminance level of the ambient light is the only input variable in determining the ambient black level.

5. The method of claim 1, further comprising:

in response to determining that the luminance level of the ambient light is not above the minimum luminance threshold:

setting the new black level to a preconfigured high dynamic range black level so long as the luminance level of the ambient light is not above the minimum luminance threshold; and setting the one or more light output levels of the one or more light sources in the plurality of light sources to a lowest light output levels.

6. The method of claim 1, comprising:

in response to determining that the luminance level of the ambient light is not above the minimum luminance threshold:

analyzing tonality information in portions of an image;

mapping the image to a new image; and rendering the new image on the display.

7. The method of claim 1, wherein a global black level of the display panel is a preconfigured high dynamic range black level when the luminance level of the ambient light is not above the minimum ambient luminance threshold; wherein the global black level is solely determined by the luminance level of the ambient light when the luminance level of the ambient light is above the minimum ambient luminance threshold but not above the maximum ambient luminance threshold; and wherein the global black level is a preconfigured display panel black level when the luminance level of the ambient light is above the maximum ambient luminance threshold.

8. The method of claim 1, wherein a global black level of the display panel is a lowest level when the luminance level of the ambient light is not above the minimum ambient luminance threshold; wherein the global black level is solely determined by the luminance level of the ambient light when the luminance level of the ambient light is above the minimum ambient luminance threshold but not above the maximum ambient luminance threshold; and wherein the global black level is set to the maximum ambient luminance threshold when the luminance level of the ambient light is above the maximum ambient luminance threshold.

9. The method of claim 1, wherein detecting a luminous level of ambient light includes continuously monitoring the luminance level of the ambient light using one or more light sensors.

10. The method of claim 1, wherein the ambient black level is a function of the luminance level of the ambient light.

11. The method of claim 1, wherein pixels of the display panel comprises a plurality of display portions illuminated by the plurality of light sources, and wherein each individual light source in the plurality of light sources is assigned to illuminate a different individual display portion in the plurality of display portions.

12. The method of claim 11, further comprising setting at least one of the plurality of light sources to a light output level above a minimal light output level, wherein the at least one of the plurality of light sources illuminates at least one of the plurality of display portions, and wherein the at least one of the plurality of display portions comprises pixels that are specified by image data of the image to be illuminated below the luminance level of the ambient light.

13. The method of claim 1, wherein the plurality of light sources is a plurality of backlights.

14. The method of claim 1, wherein the plurality of light sources is an array of LEDs.

15. The method of claim 1, wherein the display panel comprises a plurality of light valves that are controlled based on image data of the image.

16. The method of claim 1, wherein a dynamic range of contrast values of the display panel varies with the ambient black level.

17. The method of claim 1, comprising:

determining whether the luminance level of the ambient light is above a maximum ambient luminance threshold; and in response to determining that the luminance level of the ambient light is above the maximum luminance threshold, setting one or more light output levels of one or more light sources in the plurality of light sources to maximum light output levels.

18. The method of claim 1, wherein the luminance level of the ambient light is one of two or more input variables in determining the ambient black level, and wherein the two or more input variable includes at least one of a point spread function of a light source and a distance between two light sources.

19. The method of claim 1, wherein the luminance level of the ambient light is one selected from the group consisting of a photometric luminous intensity, a luminance level, a brightness level, a weighted sum of intensity values, a weighted sum of gamma-corrected values, and a luma value.

20. An apparatus comprising a processor and configured to perform the method recited in claim 1.

21. A non-transitory, computer readable storage medium, comprising software instructions, which when executed by one or more processors cause performance of the method recited in claim 1.

* * * * *